US006520768B1

(12) United States Patent
Hsu

(10) Patent No.: US 6,520,768 B1
(45) Date of Patent: Feb. 18, 2003

(54) LIGHTER STRUCTURE

(76) Inventor: Huang-Hsi Hsu, 8F, No. 14, Lane 252, Chungshan N. Rd., Sec. 6, Taipei (TW)

( * ) Notice: Subject to any disclaimer, the term of this patent is extended or adjusted under 35 U.S.C. 154(b) by 0 days.

(21) Appl. No.: 10/095,919

(22) Filed: Mar. 13, 2002

(51) Int. Cl.[7] ..... F23D 11/36
(52) U.S. Cl. ..... 431/153; 431/255; 431/344
(58) Field of Search ..... 431/153, 277, 431/255, 344, 345, 276

(56) References Cited

U.S. PATENT DOCUMENTS 5,829,963 A * 11/1998 Ichikawa ..... 431/153
5,839,892 A * 11/1998 Hwang ..... 431/153
6,146,129 A * 11/2000 Li ..... 431/255
6,171,099 B1 * 1/2001 Lin ..... 431/153
6,287,109 B1 * 9/2001 Hirota ..... 431/153

* cited by examiner

*Primary Examiner*—James C. Yeung
(74) *Attorney, Agent, or Firm*—Bacon & Thomas, PLLC

(57) ABSTRACT

A lighter structure. The lighter structure includes a push button capable of sliding on a movable section disposed on a casing of the lighter, and an elastic component situated on the outer lateral surface of the movable section opposite from a safety lock section disposed on the casing. The elastic component has one end connected to the push button enabling the push button to be depressed to release from the safety lock section and move together with the movable section to activate gas flow and spark simultaneously and thus a user only needs one hand to hold the lighter and use a single finger to perform the lighting operation conveniently and safely.

1 Claim, 7 Drawing Sheets

LIGHTER STRUCTURE

BACKGROUND OF THE INVENTION

1) Field of the Invention

The invention herein relates to a lighter structure.

2) Description of the Prior Art

In a conventional lighter, referring to FIG. 1, the lighter 1 has a rectangular casing section 10, a tube 12 extending from one end of the casing section 10, a gas receptacle 14 situated at an appropriate area inside the casing section 10, and an electric arc generator 16, wherein a gas valve output orifice 142 is laterally disposed at the top surface of the gas receptacle 14, a soft tubing 144 is coupled onto the gas valve output orifice 142, the other end of the soft tubing 144 is extended to the top end of the tube 12 and connected to the lighting section (not shown in the drawings) of the lighter 1, a push plate 146 is pivotably situated at a suitable point of the gas receptacle 14 gas valve output orifice 142, a mounting hole (not shown in the drawings) is formed in an appropriate position in the casing section 10, a press section 19 projects from the casing section 10 through the mounting hole and, furthermore, the lower surface of the press section 19 is linked to the starting section 162 of the electric arc generator 16, one electrode of the electric arc generator 16 is connected to the lighting section, and the other electrode of the electric arc generator 16 is connected to the tube 12.

Referring to FIG. 2, an arresting section 2 is appropriately situated between the press section 19 and the gas receptacle 14; the arresting section 2 has a body 20 that is pivotably situated in the casing section 10, an actuating rod 22 aligned with the body 20 is disposed along the outer side of the casing section 10, one end of the actuating rod 22 is inserted through the casing section 10 and conjoined to the body 20, an elastic component 202 is installed at one side of the body 20, and one end of the elastic component 202 is mounted inside the casing section 10; when the actuating rod 22 is released, the rebound force of the elastic component 202 causes the actuating rod 22 to return to its original position; a connecting rod 24 is movably conjoined to one end of the body 20 near the press section 19, a second elastic component 242 is installed on the connecting rod 24 and utilized when the connecting rod 24 is depressed, the second elastic component 242 restoring the connecting rod 24 back to its original position.

When the actuating rod 22 of the arresting section 2 is deployed, the connecting rod 24 is moved to the upper edge of the gas receptacle 14 and when the press section 19 is depressed, the connecting rod 24 impels the push plate 146 and causes gas contained in the gas receptacle 14 to flow through the soft tubing 44 to the lighting section, while the press section 19 is moved against the starting section 162, causing the electric arc generator 16 to discharge a spark that ignites the gas at the lighting section to complete the lighting operation; when the unmoved actuating rod 22 is again deployed by the press section 19, it is capable of causing the electric arc generator 16 to discharge a spark, but is incapable of inducing gas to flow from the gas receptacle 14 into the soft tubing 144 and thus the ignition process at the lighting section cannot be complete, though safety is ensured.

However, the inventor of the invention herein discovered that the lighter 1 is not easy to operate during actual usage due to the actuating rod 22 which cannot move the connecting rod 24 to the upper edge of the gas receptacle 14 such that when the press section 19 is depressed, only a spark is discharged by the electric arc generator 16 and the ignition process cannot be completed, resulting in numerous inconveniences and difficulties. As such, since the lighter 1 is ensured to be safe but is not convenient to utilize, effectively overcoming the drawbacks would certainly be welcomed by consumers.

SUMMARY OF THE INVENTION

Although the conventional lighter is of ensured safety but has the drawback of inconvenient utilization, the inventor of the invention conducted extensive research and testing, culminating in the successful design and development of the lighter structure of the invention herein which is comprised of a casing having a lighting section at one end; a push button at the other side; a safety lock section situated at the end of the casing opposite from the push button and another safety lock section situated at the end of the casing opposite from the movement area of the push button; a movable section disposed between the push button and the casing, with the movable section and the push button capable of moving together such that the push button slides on the movable section; and an elastic component situated on the outer lateral surface of the movable section opposite from the safety lock section, with the other end of the elastic component connected to the push button; depressing the push button causes the push button to slide along the movable section and when the safety lock section separates from the other safety lock section, the push button can be depressed such that the push button impels the movable section towards the electric arc generator and the pull plate, causing the pull plate and the electric arc generator to operate simultaneously and the gas in the gas receptacle to flow through the guide tube to the lighting section, while the electric arc generator discharges a spark that ignites the gas at the lighting section; therefore, the user only needs one hand to hold the lighter and use a single finger to actuate the safety lock section to efficiently perform the lighting operation and, furthermore, in a manner that is convenient and ensured to be safe.

DETAILED DESCRIPTION OF THE INVENTION

Figure 1:
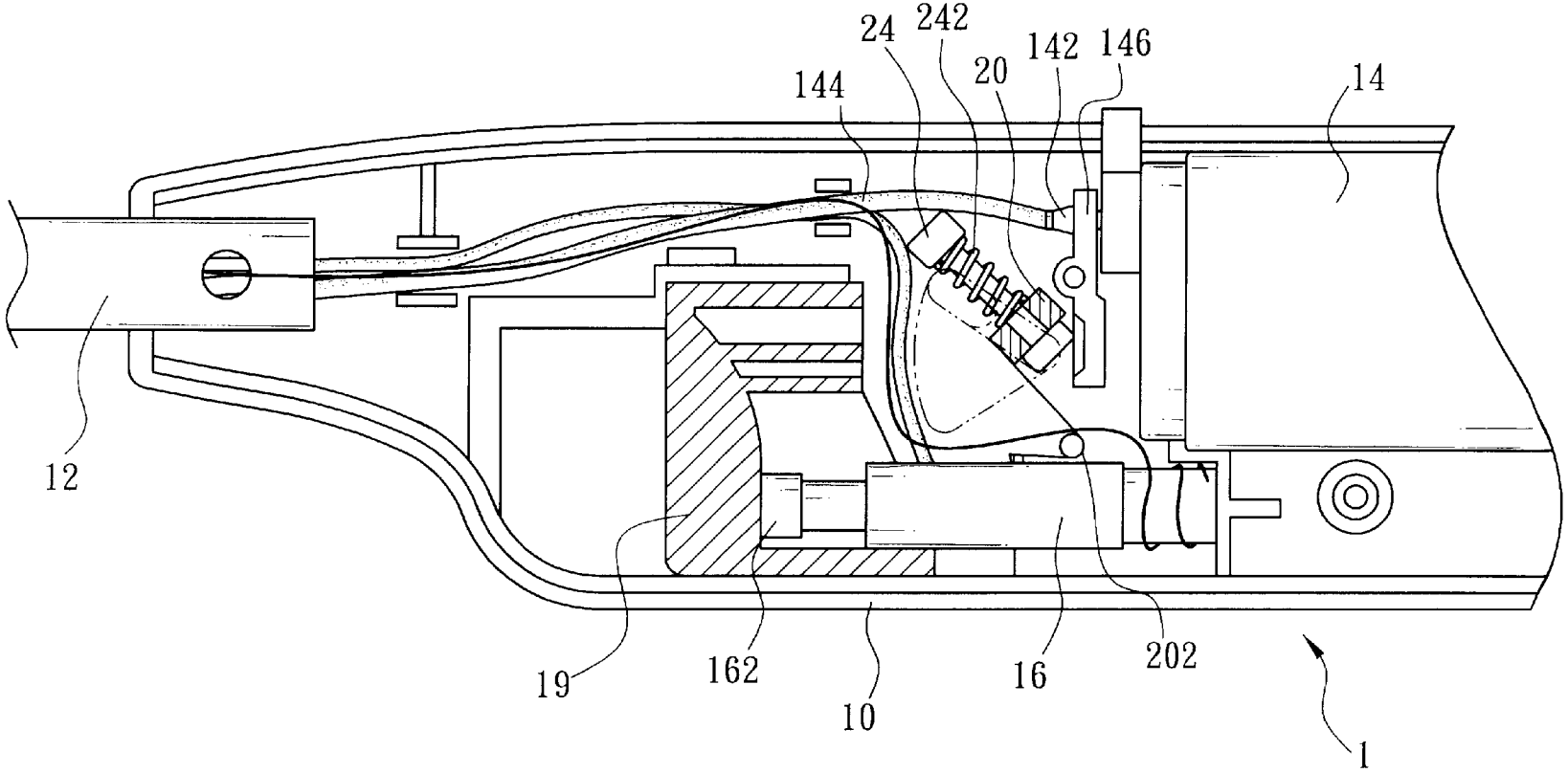
FIG. 1 (Prior Art)
FIG. 1 is a cross-sectional drawing of a conventional lighter.
Figure 2:
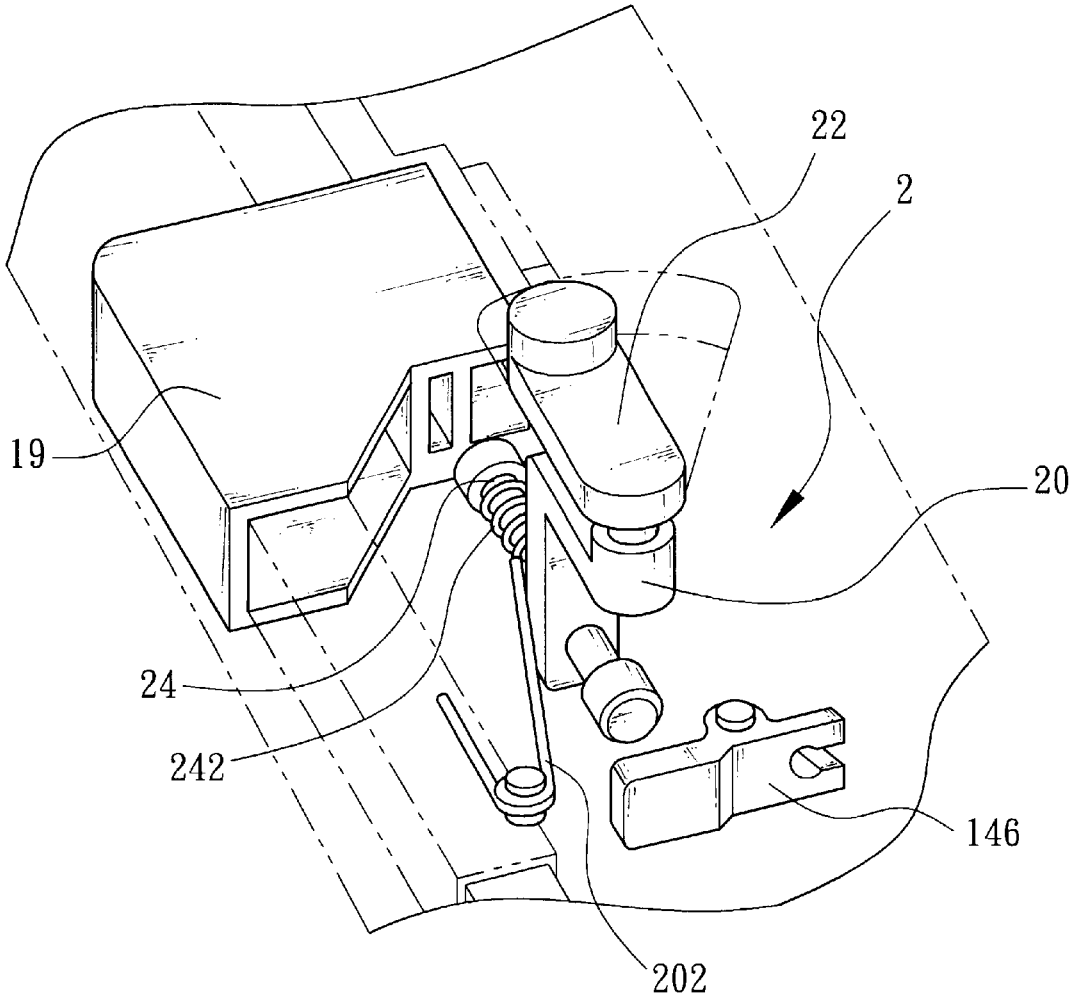
FIG. 2 (Prior Art)
FIG. 2 is an isometric drawing of FIG. 1.
Figure 3:
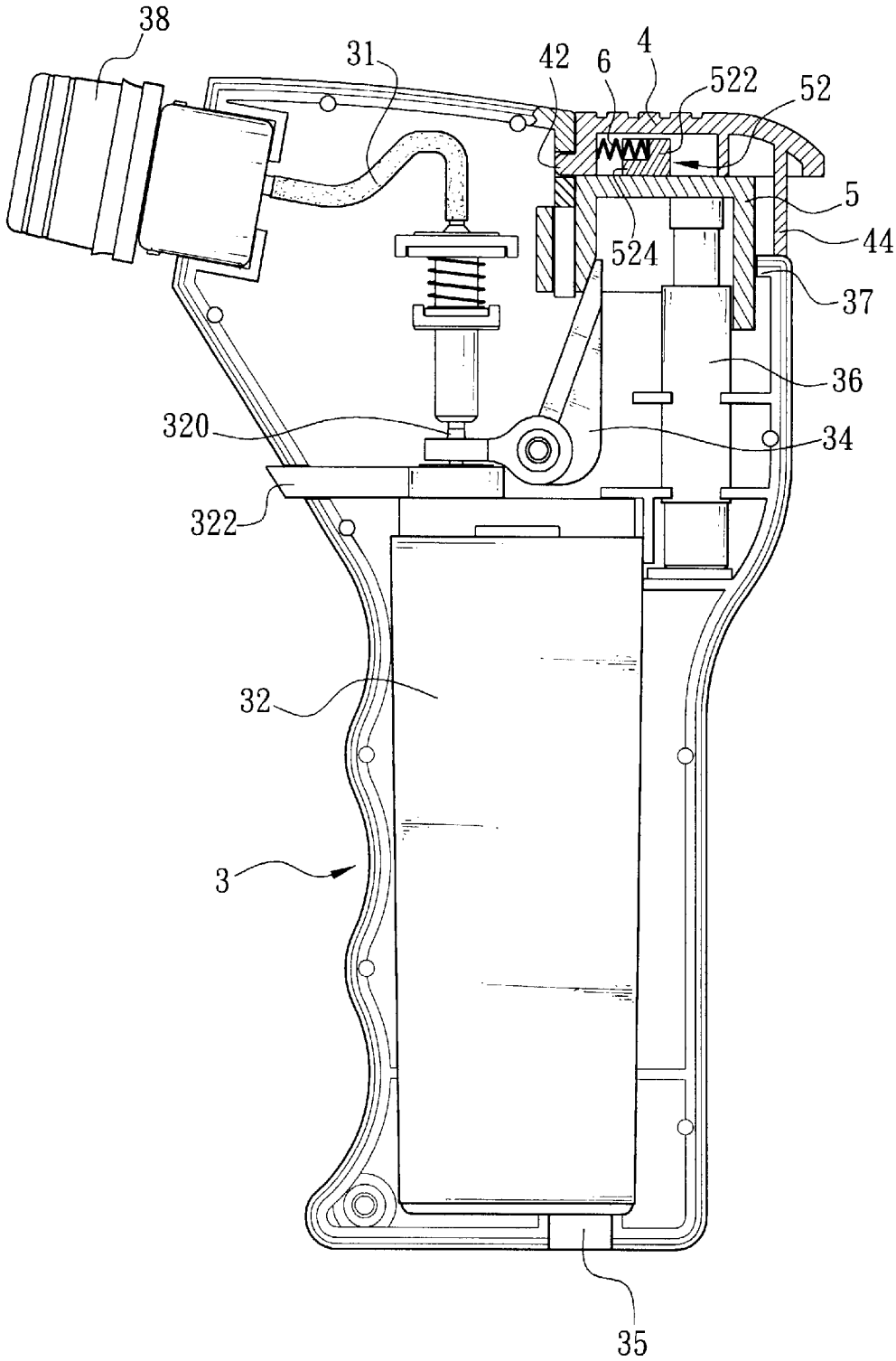
FIG. 3 is a cross-sectional drawing of an embodiment of the invention herein.
Figure 4:
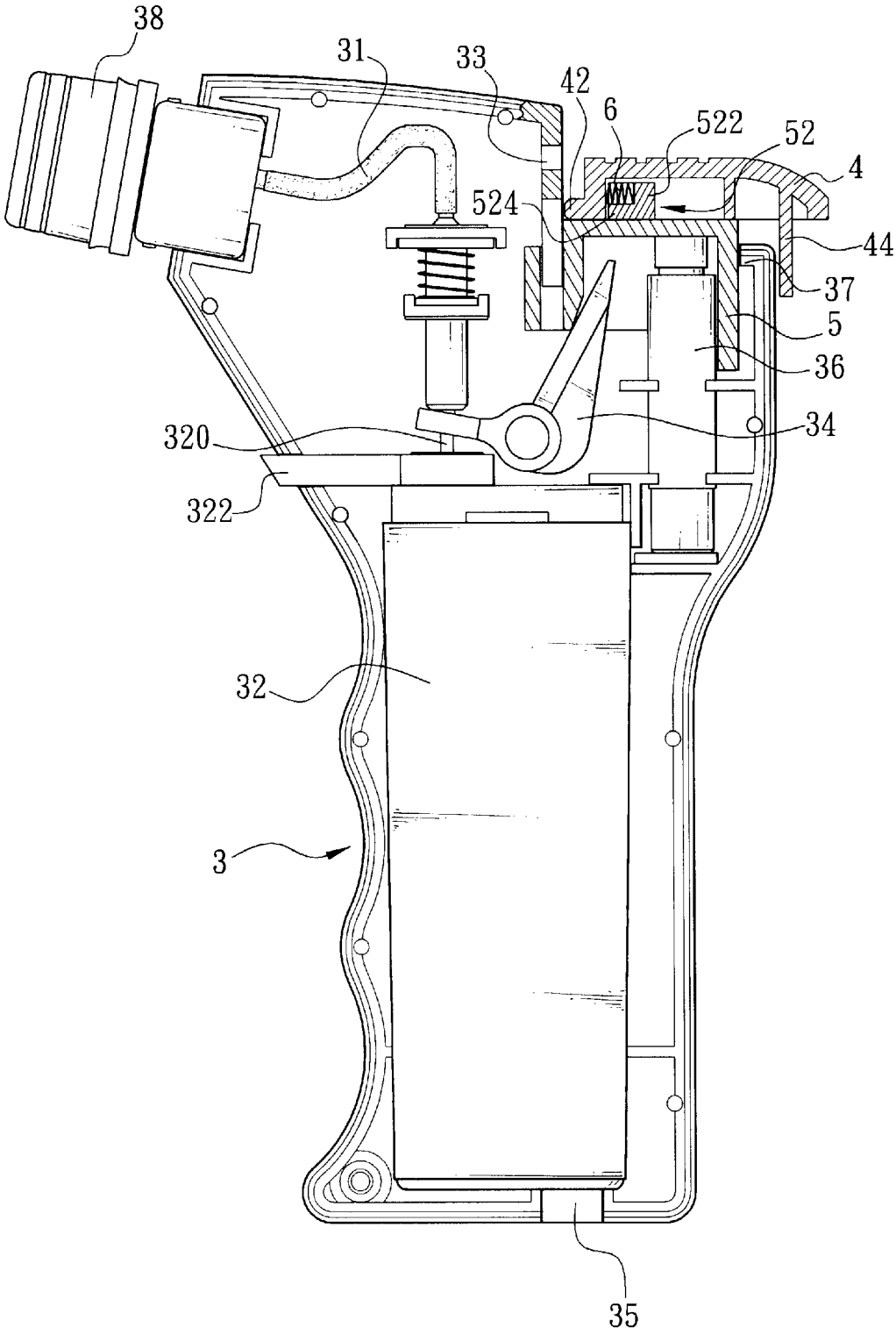
FIG. 4 is a cross-sectional drawing that illustrates the depressing of the push button.

The lighter structure of the invention herein, referring to FIG. 3 and FIG. 4, consists of a casing 3 of an exterior shape similar to a pistol grip, the casing 3 providing for user grasping; a gas receptacle 32 near one end inside the casing 3 and the gas receptacle 32 filled with liquefied gas; a gas output valve 320 proximal to the other end of the casing connected to the gas receptacle 32; a pull plate 34 that is disposed at an appropriate position against the gas output valve 320 and controls the release of the gas output valve 320, with the pull plate 34 extending laterally from the other end of the casing 3 such that articulating the pull plate 34 governs the operation of the gas output valve 320; and an electric arc generator 36 situated on the pull plate 34.

The casing 3 has laterally situated at its other end a lighting section 38 that is proximal to a guide tube 31, one extremity of which is adjacent to the gas output valve 320 and the other extremity of the guide tube 31 is connected to the output orifice of the gas output valve 320; one electrode of the electric arc generator 36 is connected to the lighting section 38 and the other electrode of the electric arc generator 36 is connected to the inner side of the lighting section 38; a push button 4 is disposed on the other side of the casing 3 opposite from the lighting section 38; a safety lock section 42 is situated at the end of the casing 3 opposite from the push button 4 and another safety lock section 33 is situated at the end of the casing 3 opposite from the movement area of the push button 4; a movable section 5 is disposed between the push button 4 and the casing 3, with the movable section 5 and the push button 4 capable of moving together such that the push button 4 slides on the movable section 5; an elastic component 6 is situated on the outer lateral surface of the movable section 5 opposite from the safety lock section 42, with the other end of the elastic component 6 connected to the push button 4 such that when the safety lock section 42 is moved away from the other safety lock section 33, the safety lock section 42 extends into the other safety lock section 33, the push button 4 cannot be depressed, the inner lateral surface of the movable section 5 is against the safety lock section 42 and the pull plate 34 and, furthermore, the safety lock section 42 and the other safety lock section 33 are correspondingly positioned on them.

Depressing the push button 4 causes the push button 4 to slide along the movable section 5 and when the safety lock section 42 separates from the other safety lock section 33, the push button 4 can be depressed such that the push button 4 impels the movable section 5 towards the electric arc generator 36 and the pull plate 34, causing the pull plate 34 and the electric arc generator 36 to operate simultaneously and the gas in the gas receptacle 32 to flow through the guide tube 31 to the lighting section 38, while the electric arc generator 36 discharges a spark that ignites the gas at the lighting section 38; therefore, the user only needs one hand to hold the lighter and use a single finger to actuate the safety lock section 42 to efficiently perform the lighting operation and, furthermore, in a manner that is convenient and ensured to be safe.

In the invention herein, an adjuster 322 is connected between the gas receptacle 32 and the gas output valve 320; the adjuster 322 is disposed away from the end of the gas receptacle 32 protruding from the casing 3 and rotating the adjuster 322 varies the flow volume of the gas receptacle 32; the gas receptacle 32 has a refill valve (not shown in the drawings) at one end of the gas output valve 320 and an entrance 35 is formed in the casing 3 over the refill valve such that the output valve of a gas refill canister can be inserted through the entrance 35 in the casing 3 and the gas refill canister output valve is coupled to the refill valve to deliver gas contained in the gas refill canister into the gas receptacle 32; as such, the lighter does not have to be wastefully discarded because gas in the gas receptacle 32 is depleted.

In the invention herein, a stop section 37 lower than the height of the movable section 5 is situated next to the movable section 5 at the side of the casing 3 away from the lighting section 38, an extension section 44 is disposed at one end of the safety lock section 42 away from the inner lateral surface of the push button 4 and, furthermore, when the safety lock section 42 is extended into the other safety lock section 33, the extension section 44 rests against the stop section 37 such that the push button 4 is not easily depressed.

In the invention herein, the movable section 5 has an L-shaped check block 52 facing the push button 4 and the check block 5 has a vertical section 522 positioned at one end of the elastic component 6 such that when the push button 4 is impelled against the horizontal section 524 of the check block 52, the safety lock section 42 separates from the other safety lock section 33 and, furthermore, the extension section 44 and the stop section 37 separate, enabling the depressing of the push button 4.

Figure 5:
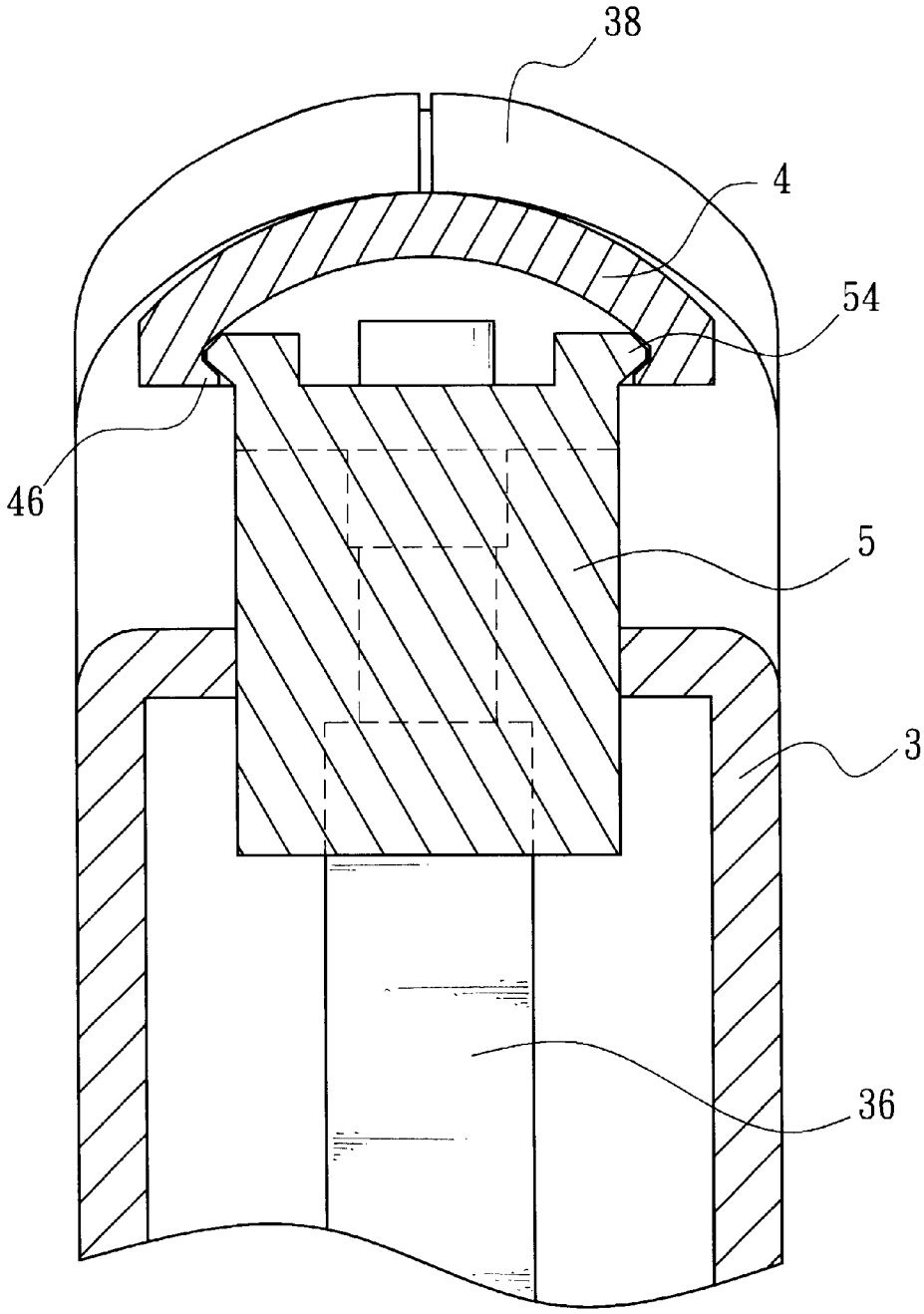
FIG. 5 is a cross-sectional drawing of that shows the push button in contact with the movable section.

In the invention herein, referring to FIG. 5, the push button 4 has a sliding section 46 at each of its two sides facing the movable section 5 and the movable section 5 has another sliding section 54 over the sliding section 46 such that the push button 4 and the movable section 5 are actively linked together and, furthermore, when the push button 4 is impelled, the sliding sections 46 travel along the other sliding section 54 and the push button 4 does not easily wobble during the impelling process.

Figure 6:
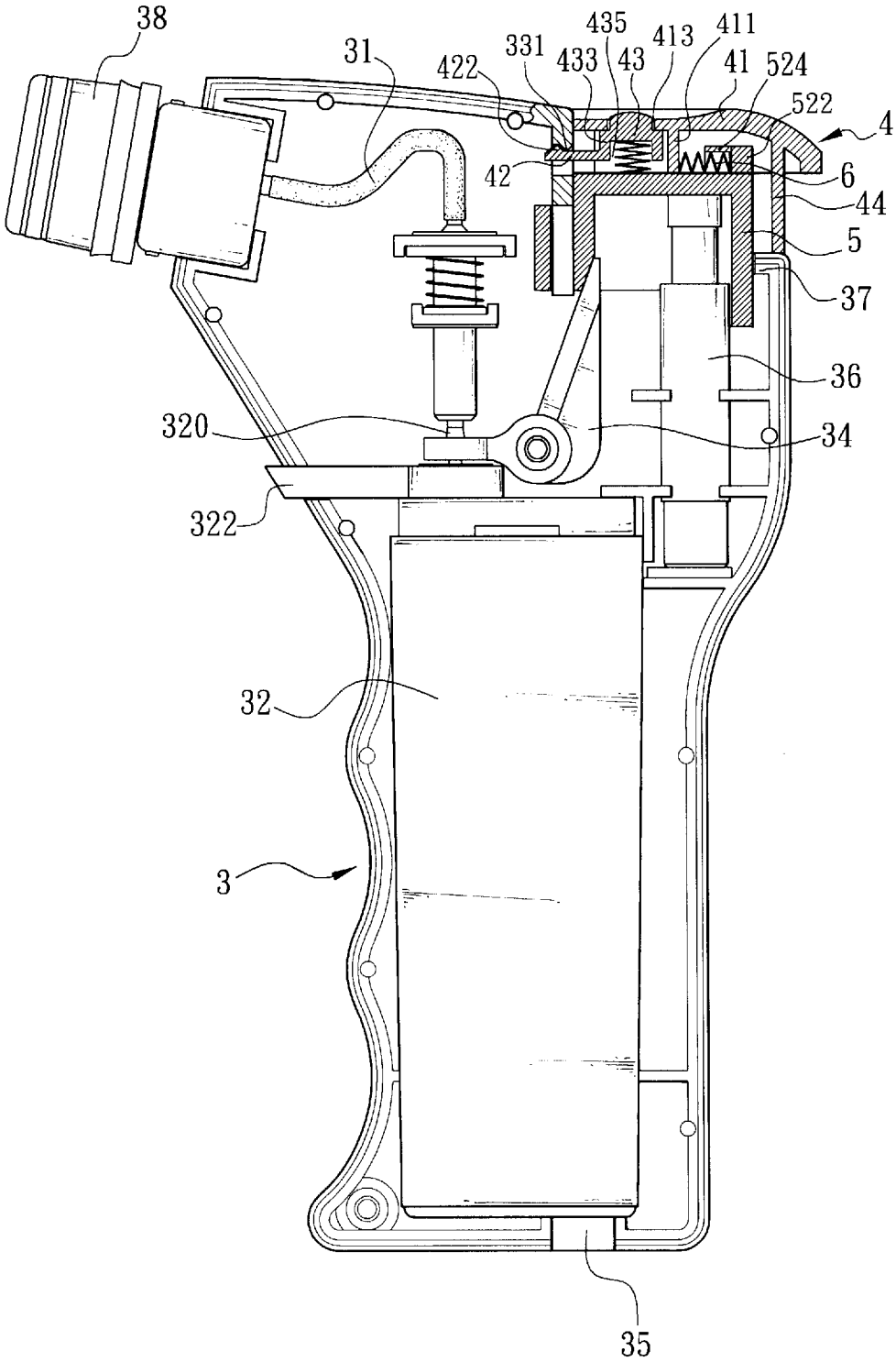
FIG. 6 is a cross-sectional drawing of another embodiment of the invention herein.
Figure 7:
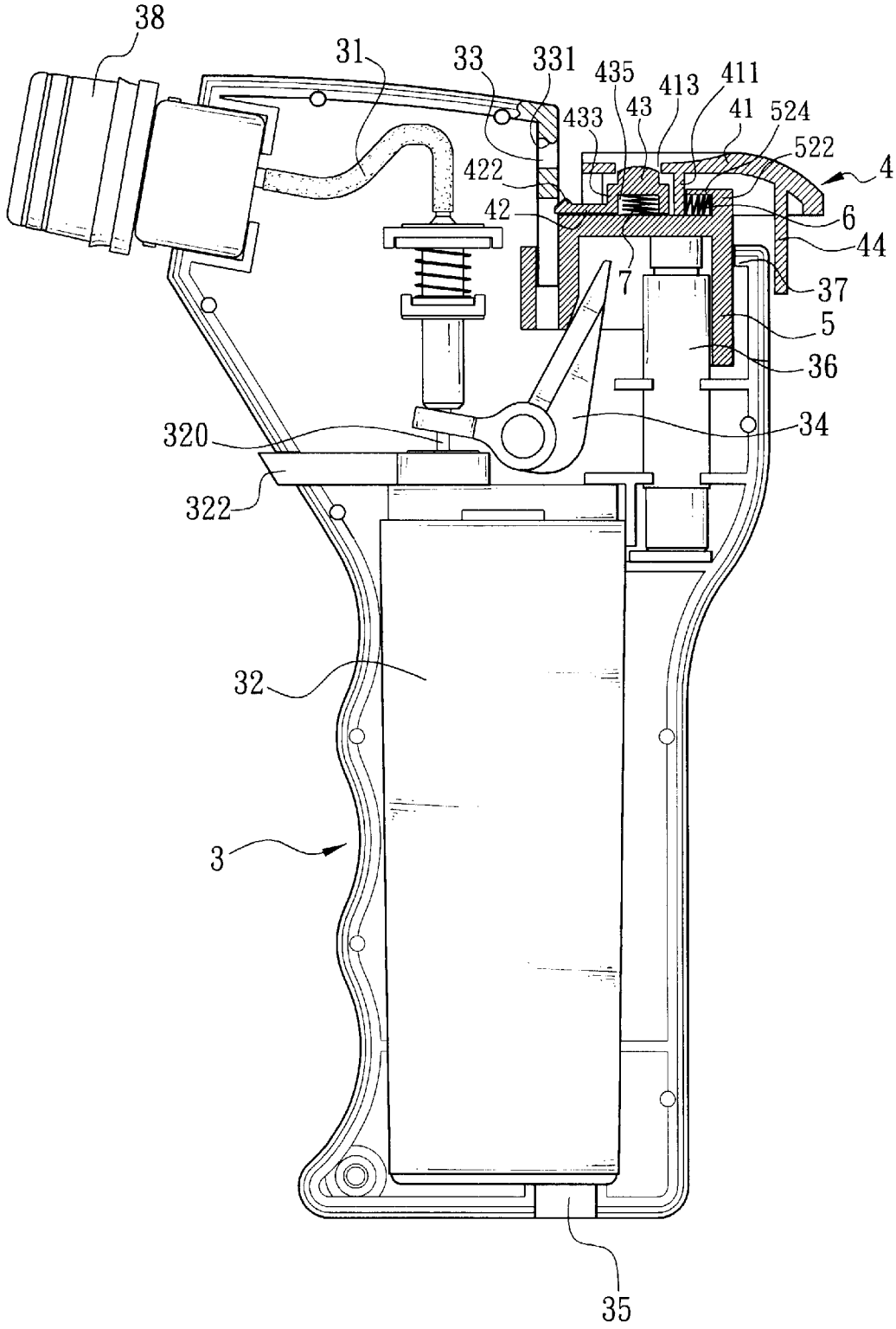
FIG. 7 is a cross-sectional drawing of FIG. 6 when the push button is depressed.

In the invention herein, referring to FIG. 6, and FIG. 7, the push button 4 consists of a body 41 and a press portion 43, wherein the body 41 has a dividing block 411 near its center, the check block 52 is situated on the surface at one side of the body 41 apart from the other safety lock section 33 at the end, the elastic component 6 is positioned between the dividing block 411 and the check block 52, and an opening 413 is formed in the body 41 at an appropriate point between the dividing block 411 and the other safety lock section 33; the press portion 43 has a shoulder section 433 formed on one end and the shoulder section 433 has a recessed space 435 in one end of the press portion 43; another elastic component 7 is contained in the recessed space 435; the safety lock section 42 is situated at the shoulder section 433 opposite from one end of the other safety lock section 33; the safety lock section 42 has a protruding section 422 situated at one side of the gas receptacle 32 away from one end of the body 41; the other safety lock section 33 has another protruding section 331 at one end facing the protruding section 422; and, furthermore, the other safety lock section 33 has a certain distance, enabling the insertion of the protruding section 422 into the casing 3 and coupling to the other protruding section 331.

The press portion 43 is inserted into and assembled to the body 41 at the opening 413, enabling a part of the press portion 43 to protrude through the opening 413, the positioning of the press portion 43 through the other elastic component 7 inside the body 41, and the placement of the shoulder section 433 against the periphery of the opening 413, while the elastic component 6 causes the protruding section 422 to extend from the other safety lock section 33 into the casing 3 and, furthermore, its coupling to the other protruding section 331; as such, the lighter is fully capable of the objective of igniting a flame and before operating the body 41, the press portion 43 must first be depressed to separate the protruding section 422 from the other protruding section 331, following which the body 41 can be operated in that the safety lock section 42 is completely separated from inside the casing 3 and the extension section 44 is separated from the stop section 37; the body 41 is then depressed, causing gas in the gas receptacle 32 to flow through the guide tube 31 to the lighting section 38, while the electric arc generator 36 discharges a spark at the lighting section 38, igniting the gas at the lighting section 38 to achieve the objective of producing a flame.

What is claimed is:

1. A lighter structure comprised of:

a casing;

a gas receptacle proximal to one end inside said casing;

said gas receptacle filled with liquefied gas and a gas output valve proximal to another end of said casing is connected to said gas receptacle and controls release of gas;

a pull plate disposed at an appropriate position against said gas output valve, with said pull plate extending laterally from said another end of said casing such that articulating said pull plate governs operation of said gas output valve;

an electric arc generator situated on said pull plate;

a lighting section situated near one end of said casing that is proximal to a guide tube, one extremity of which is adjacent to said gas output valve and another extremity of said guide tube is connected to an output orifice of said gas output valve;

one electrode of said electric arc generator is connected to said lighting section and another electrode of said electric arc generator is connected to an inner side of said lighting section;

a push button disposed on a side of said casing opposite from said lighting section;

a safety lock section is situated at one end of said push button and another safety lock section is situated in a movement area of the said push button;

a movable section disposed between said push button and said casing, with said movable section and said push button capable of moving together such that said push button slides on said movable section;

an elastic component situated on an outer lateral surface of said movable section opposite from said safety lock section, with one end of said elastic component connected to said push button such that when said safety lock section is moved away from said another safety lock section, said safety lock section extends into said another safety lock section and said push button cannot be depressed, an inner lateral surface of said movable section is positioned against said electric arc generator and said pull plate and said safety lock section and said another safety lock section are correspondingly positioned on thereon;

wherein said push button comprises a body having a dividing block near a center thereof and an opening is formed in said body at a point between said dividing block and said another safety lock section;

a press portion having a shoulder section formed on one end thereof and said shoulder section has a recessed space in one end of said press portion;

another elastic component is contained in said recessed space, said safety lock section is situated at said shoulder section opposite from one end of said another safety lock section, said safety lock section has a protruding section situated at one side of said gas receptacle away from one end of said body, said another safety lock section has another protruding section at one end thereof facing said protruding section, and said another safety lock section has a length enabling insertion of said protruding section into said casing and coupling to said another protruding section;

said check block is situated on a surface at one side of said body opposite from said movable section and apart from said another safety lock section at an end thereof and said elastic component positioned between said dividing block and said check block; and said press portion is inserted into and assembled to said body at said opening, enabling a part of said press portion to protrude through said opening, positioning of said press portion through said another elastic component inside said body, and placement of said shoulder section against a periphery of said opening, while said elastic component causes said protruding section to extend from said another safety lock section into said casing and coupling to said another protruding section.

* * * * *